US008393861B2

(12) United States Patent
Wada et al.

(10) Patent No.: US 8,393,861 B2
(45) Date of Patent: Mar. 12, 2013

(54) STEAM DEVICE

(75) Inventors: Kunihiko Wada, Yokohama (JP); Katsuya Yamashita, Tokyo (JP); Yutaka Ishiwata, Zushi (JP); Yuujiro Nakatani, Tokyo (JP); Takeo Suga, Yokohama (JP); Asako Inomata, Yokohama (JP); Kazuhiro Saito, Yokohama (JP); Takao Inukai, Kawasaki (JP); Yusuke Suzuki, Yokohama (JP); Shogo Iwai, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 117 days.

(21) Appl. No.: 13/116,635

(22) Filed: May 26, 2011

(65) Prior Publication Data

US 2011/0280717 A1 Nov. 17, 2011

Related U.S. Application Data

(63) Continuation of application No. PCT/JP2009/006378, filed on Nov. 26, 2009.

(30) Foreign Application Priority Data

Nov. 27, 2008 (JP) ..... 2008-301958
Sep. 2, 2009 (JP) ..... 2009-202907

(51) Int. Cl.
*F01D 25/24* (2006.01)

(52) U.S. Cl. ..... 415/200; 415/178; 415/108

(58) Field of Classification Search ..... 415/108, 415/200, 178
See application file for complete search history.

(56) References Cited

U.S. PATENT DOCUMENTS 4,927,714 A 5/1990 Priceman
5,851,679 A 12/1998 Stowell et al.
5,896,895 A * 4/1999 Simpkin ..... 138/149
6,207,295 B1 3/2001 Stowell et al.
6,294,261 B1 9/2001 Sangeeta et al.
(Continued)

FOREIGN PATENT DOCUMENTS

EP 1 666 784 B1 6/2006
EP 1 849 881 A2 10/2007
(Continued)

OTHER PUBLICATIONS

JIS K 5600, Testing methods for paints, Part 5: Mechanical property of film-Section 6:Adhesion test.

(Continued)

*Primary Examiner* — Ninh H Nguyen
(74) *Attorney, Agent, or Firm* — Foley & Lardner LLP

(57) ABSTRACT

In one embodiment, a steam device includes a high-temperature member and a low-temperature member. One surface of the high-temperature member is exposed to high-temperature steam, and the other surface is cooled by cooling steam having a temperature lower than the high-temperature steam. The low-temperature member is disposed to face the high-temperature member with a passage for the cooling steam therebetween and is formed of a material having a heat resistance lower than that of the high-temperature member. The steam device has at least one high-reflectance film selected from a first high-reflectance film, which is formed on the surface of the high-temperature member which is exposed to the high-temperature steam and has a higher reflectance with respect to infrared rays than the high-temperature member, and a second high-reflectance film, which is formed on the surface of the low-temperature member facing the high-temperature member and has a higher reflectance with respect to infrared rays than the low-temperature member.

30 Claims, 11 Drawing Sheets

U.S. PATENT DOCUMENTS

| | | | | |
|---|---|---|---|---|
| 6,345,953 | B1 | 2/2002 | Henkel et al. | |
| 6,699,604 | B1 | 3/2004 | Li et al. | |
| 6,767,659 | B1 * | 7/2004 | Campbell | 428/701 |
| 2003/0008170 | A1 | 1/2003 | Allen et al. | |
| 2004/0258946 | A1 | 12/2004 | Allen et al. | |
| 2005/0039459 | A1 | 2/2005 | Ackermann et al. | |
| 2007/0031249 | A1 | 2/2007 | Jones | |
| 2007/0140840 | A1 | 6/2007 | Schmitz et al. | |
| 2009/0053069 | A1 | 2/2009 | Barnikel et al. | |
| 2009/0202814 | A1 | 8/2009 | Jabado et al. | |

FOREIGN PATENT DOCUMENTS

| | | | |
|---|---|---|---|
| JP | 07-247806 | A | 9/1995 |
| JP | 3095745 | B1 | 8/2000 |
| JP | 2000-282808 | A | 10/2000 |
| JP | 2001-081577 | A | 3/2001 |
| JP | 2001-226759 | A | 8/2001 |
| JP | 2002-054802 | A | 2/2002 |
| JP | 2002-504641 | A | 2/2002 |
| JP | 2003-055756 | A | 2/2003 |
| JP | 2004-501051 | A | 1/2004 |
| JP | 2004-211703 | | 7/2004 |
| JP | 2004-353603 | A | 12/2004 |
| JP | 2007-514094 | A | 5/2007 |
| WO | WO 2006/103127 | A1 | 10/2006 |
| WO | WO 2006/133980 | A1 | 12/2006 |

OTHER PUBLICATIONS

M. Yoshida et al, "Development and Performance Evaluation of High-Temperature Coating Systems", Function and Materials, vol. 28, No. 1, Jan. 2008, pp. 6-18.

* cited by examiner

FIG. 4

| | Refractive index | Low refractive material | High refractive material |
|---|---|---|---|
| $Ga_2O_3$ | 1. 45 | ○ | |
| $Al_2O_3$ | 1. 63 | ○ | |
| MgO | 1. 74 | ○ | |
| $Sm_2O_3$ | 1. 8 | ○ | |
| $Y_2O_3$ | 1. 87 | ○ | |
| $SiO_2$ | 1. 9 | ○ | |
| $HfO_2$ | 1. 95 | ○ | ○ |
| NiO | 2 | ○ | ○ |
| $ZrO_2$ | 2. 05 | ○ | ○ |
| ZnO | 2. 1 | | ○ |
| $ZrO_2+TiO_2$ | 2. 1 | | ○ |
| $Ta_2O_5$ | 2. 16 | | ○ |
| $Ce_2O_3$ | 2. 2 | | ○ |
| $WO_3$ | 2. 2 | | ○ |
| $Cr_2O_3$ | 2. 24 | | ○ |
| $Nb_2O_5$ | 2. 33 | | ○ |
| $TiO_2$ | 2. 4 | | ○ |

STEAM DEVICE

CROSS-REFERENCE TO RELATED APPLICATIONS

This application is a continuation of prior International Application No. PCT/JP2009/006378, filed on Nov. 26, 2009 which is based upon and claims the benefit of priority from Japanese Patent Application No. 2008-301958, filed on Nov. 27, 2008 and Japanese Patent Application No. 2009-202907, filed on Sep. 2, 2009; the entire contents of all of which are incorporated herein by reference.

FIELD

Embodiments described herein relate generally to a steam device.

BACKGROUND

A steam temperature is less than 600° C. in a steam device in which high-temperature steam is passed, such as a steam turbine of a conventional thermal power generating plant. Therefore, a ferritic heat-resistant steel is generally used considering economical efficiency and manufacturability for the major parts of high temperature portions (such as turbine rotors, moving blades, etc.) of the steam turbine.

To provide the thermal power generating plant with high efficiency in view of the environmental conservation in these years, steam turbines using high-temperature steam of about 600° C. are being operated. In such steam turbines, the steam temperature is increased to a high level, so that the high-temperature strength of the ferritic heat-resistant steel is insufficient. Therefore, a heat-resistant alloy mainly made of nickel or an austenitic heat-resistant steel is used for some of the steam turbines.

At present, a steam turbine using higher-temperature steam of 650° C. or more is also being considered. In view of economical efficiency and manufacturability, there are disclosed technologies that a steam turbine power plant is configured with portions using heat-resistant alloys and austenitic heat-resistant steels decreased as much as possible.

The steam turbine power plant has a superhigh-pressure turbine portion, a high-pressure turbine portion, an intermediate-pressure turbine portion, a low-pressure turbine (1), a low-pressure turbine (2) and a generator connected to a single axis, and the superhigh-pressure turbine and the high-pressure turbine are independently built into the same outer casing. In this steam turbine power plant, use of the heat-resistant alloy and the austenitic heat-resistant steel is limited to a particularly high temperature portion of the superhigh-pressure turbine portion.

But, to realize a high temperature such that a steam temperature exceeds 700° C., only an increase of the heat-resistant temperature of the base material metal is limited, and a technology to cool high-temperature parts by the cooling steam is indispensable. There is a disclosed patent related to the above cooling technology.

In the field of gas turbines, there has been used a thermal barrier coating technology to cool the inner surfaces of high temperature parts by forming a low heat conductive ceramics layer on the surfaces in order to protect members using a Ni-based superalloy or a Co-based superalloy having high strength from a high temperature combustion gas. It is general to use a thermal spraying method to form the ceramics layer, but it is also considered to use a slurry/gel coating method using a ceramics precursor in order to smoothen the surface.

But, since steam is heat-emitting gas due to radiation of infrared rays in the steam turbine, there are technically different problems that radiant heat transmission becomes more significant, not only a heat receiving member but also a heat radiating member are required to have thermal barrier performance. And, a ceramics thermal barrier coating for the gas turbine according to the mainstream thermal spraying method has pores in the ceramics layer to realize low heat transmission. But, it is worried that the steam turbine has a problem that a thermal conductivity increases because steam having a high thermal conductivity enters into the pore portion.

For the steam turbine having a steam temperature of exceeding 700° C. described above, various methods have been considered to assure the strength of turbine component parts. In conventional thermal power generating plants, the improved heat-resistant steel is being used for turbine component parts such as a turbine rotor, a nozzle, a moving blade, a nozzle box (steam chamber), a steam inlet pipe and the like used for the steam turbine. But, if the steam temperature exceeds 700° C., it is hard to assure the strength of the turbine component parts by the heat-resistant steel.

Therefore, for the steam turbine, it is expected to have a technology that a conventional improved heat-resistant steel having excellent economical efficiency and reliability is used for the low-temperature portions, a material having high heat resistance is limited to be used for the portions exposed to the high-temperature steam, and cooling steam is introduced between them. But, for example, to cool down the turbine rotor and the casing by the cooling steam in order to apply the conventional material to the member corresponding to a first stage of the turbine, a cooling steam amount corresponding to several percents of the main stream of steam is necessary. And, a flow of the cooling steam into the steam passage portion has a problem of lowering the internal efficiency of a single turbine involved in degradation of total performance.

BRIEF DESCRIPTION OF THE DRAWINGS

FIG. 4 is a view illustrating combination examples of low refractive index materials and high refractive index materials made of dielectric oxides.

DETAILED DESCRIPTION

In an embodiment, a steam device includes a first member one side of which is exposed to high-temperature steam and the other side of which is cooled by low-temperature steam having a temperature lower than that of the high-temperature steam, and a second member which is disposed to face the first member with a passage for the low temperature steam between them and is formed of a material having a heat resistance lower than that of the first member, wherein the steam device has at least one of a first high-reflectance film which is formed on the surface of the first member exposed to the high-temperature steam and which has a reflectance with respect to infrared rays higher than the first member; and a second high-reflectance film which is formed on the surface of the second member facing the first member and which has a reflectance with respect to infrared rays higher than the second member.

In an embodiment, a steam device includes a first member one side of which is exposed to high-temperature steam and the other side of which is cooled by low-temperature steam having a temperature lower than that of the high-temperature steam, and a second member which is disposed to face the first member with a passage for the low temperature steam between them and is formed of a material having a heat resistance lower than that of the first member, wherein the steam device has a low-emissivity film which is formed on the surface of the first member cooled by the low-temperature steam and which has emissivity lower than the first member.

In an embodiment, a steam device includes a first member one side of which is exposed to high-temperature steam and the other side of which is cooled by low-temperature steam having a temperature lower than that of the high-temperature steam, and a second member which is disposed to face the first member with a passage for the low temperature steam between them and is formed of a material having a heat resistance lower than that of the first member, wherein the steam device has at least one of a first high-reflectance film which is formed on the surface of the first member exposed to the high-temperature steam and which has a reflectance with respect to infrared rays higher than the first member, and a second high-reflectance film which is formed on the surface of the second member facing the first member and which has a reflectance with respect to infrared rays higher than the second member; and has a low-emissivity film which is formed on the surface of the first member cooled by the low-temperature steam and which has emissivity lower than the first member.

Embodiments of the present invention are described in detail below with reference to the drawings.

Figure 1:
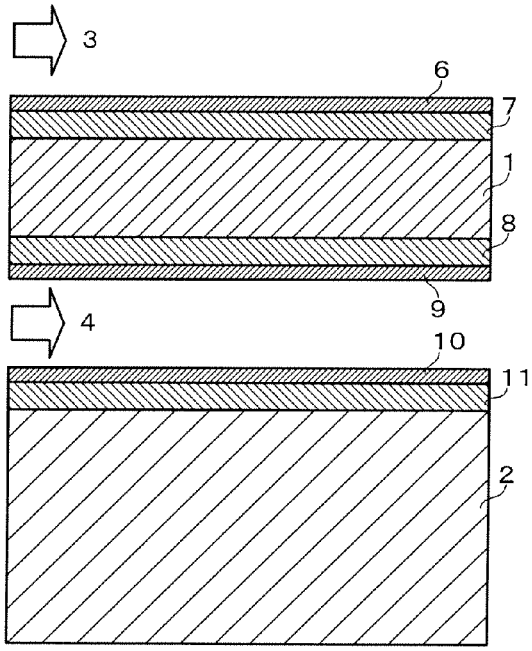
FIG. 1 is a view schematically showing a cross-sectional structure of a main portion of one embodiment.

FIG. 1 is a view schematically showing a cross-sectional structure of a main portion of a steam turbine according to an embodiment of the present invention. In a case of cooling a high-temperature member (member having high heat resistance) of a steam turbine using high-temperature steam exceeding a heat-resistant temperature of 550° C. (e.g., about 600° C. to 700° C.) of a ferritic heat-resistant steel by low-temperature steam, a high-temperature member (member having high heat resistance) 1 that is exposed to high-temperature steam 3, and a low-temperature member (member having heat resistance lower than the high-temperature member) 2 that mainly assures the strength of the steam turbine are configured to face each other with a passage for cooling steam 4 interposed between them as shown in FIG. 1. In FIG. 1, 5 denotes the atmosphere.

As to the flow of heat in the above members, heat is conducted from the high-temperature steam 3 to the high-temperature member 1, it is partly conducted to downstream of low temperature steam through the inside of the high-temperature member 1, and the balance is consumed to increase the temperature of the cooling steam 4. The temperature increase of the cooling steam 4 finally increases a temperature of the low-temperature member 2.

In this embodiment, a first high-reflectance film 6 having a higher reflectance with respect to infrared rays than that of the high-temperature member 1 is formed on the surface of the high-temperature member 1 exposed to the high-temperature steam 3. Heat is transmitted from the high-temperature steam 3 to the high-temperature member 1 by convection heat transmission and radiation heat transmission. Therefore, the heat transmission from the steam is suppressed by the first high-reflectance film 6, and it is possible to decrease a temperature increase of the high-temperature member 1.

To improve a heat shielding effect, it is more effective to form a first low heat conductive film 7 on a surface of the high-temperature member 1 which is exposed to the high-temperature steam 3. In FIG. 1, the first low heat conductive film 7 is formed between the first high-reflectance film 6 and the high-temperature member 1. But, when the first low heat conductive film 7 has a high infrared-ray transmission rate, the first low heat conductive film 7 is formed on the outside of the first high-reflectance film 6, and it is also possible to provide the first low heat conductive film 7 with a role of protecting the infrared ray reflection film from a steam or erosion environment. And, regardless of the thermal conductivity, it is also possible to form separately and additionally on the outermost surface a film which has a high infrared-ray transmission rate and a role of protecting from the steam or erosion environment. As a material for the first low heat conductive film 7, it is preferable to use a material having a thermal conductivity of 5 W/mK or less. The same is also applied to another low heat conductive film described later.

In a case where steam turbine parts are steam-cooled, an alloy or the like having a high heat-resistant temperature is used for the high-temperature member 1 and has a margin in view of high temperature strength, but since it is considered to use a general ferritic steel for the low-temperature member 2, a temperature increase of the low-temperature member 2 has a high possibility of causing serious damage or degradation of the steam turbine. Therefore, to reduce damage to the parts, it is effective that a heat radiation amount from the high-temperature member 1 to the cooling steam 4 is reduced, a temperature increase of the cooling steam 4 is suppressed, and a temperature increase of the low-temperature member 2 is reduced.

To reduce the heat radiation amount to the cooling steam 4, it is effective to form a low-emissivity film 9 having emissivity lower than that of the high-temperature member 1 on the cooling steam passage side of the high-temperature member 1. Theoretically, since the emissivity, reflectance and absorption rate of the electromagnetic wave become 1 when they are summed, it may be considered that the low-emissivity is synonymous with high reflectance if the absorption rate does not change. Therefore, it is also possible to use one and same material for the first high-reflectance film 6 and the low-emissivity film 9. Thus, it is possible to form simultaneously the film on two surfaces of the high-temperature steam 3 side and the cooling steam 4 side of the high-temperature member 1 by, for example, immersing the high-temperature member 1 in a slurry, and it is preferable in view of simplification of the manufacturing process.

It is also effective to form a second low heat conductive film 8 on the surface of the high-temperature member 1 on the cooling steam 4 side in viewpoint of suppressing a temperature increase of the cooling steam 4. But, as to the second low heat conductive film 8 on the heat radiation side, it is more effective to promote the heat transmission aggressively and to decrease the temperature of the high-temperature member 1 when the cooling steam amount is large and the temperature increase of the low-temperature member 2 does not become a design problem. Therefore, there is a desirable case or portion that a film with high emissivity and thermal conductivity is formed without forming the second low heat conductive film 8.

In addition, to suppress heat input from the cooling steam 4, a second high-reflectance film 10 having higher reflectance with respect to the infrared rays than the low-temperature member 2 is formed on the surface of the low-temperature member 2 which is opposed to the high-temperature member 1. When a third low heat conductive film 11 is formed on the surface of the low-temperature member 2 which is opposed to the high-temperature member 1, the heat shielding effect can be improved furthermore.

In the above-configured embodiment, it is sufficient by forming at least one of the above-described first high-reflectance film 6, second high-reflectance film 10 and low-emissivity film 9, and any two or all of them may also be formed. And, the first low heat conductive film 7, the second low heat conductive film 8 and the third low heat conductive film 11 are not necessarily disposed, and any one, any two or all of them may be disposed.

The process of forming the first high-reflectance film 6, the second high-reflectance film 10, the low-emissivity film 9, the first low heat conductive film 7, the second low heat conductive film 8 and the third low heat conductive film 11 shown in FIG. 1 is not particularly limited, but they can be formed by, for example, a thermal spraying method, a physical vapor deposition method, a chemical vapor deposition method, a slurry method or the like.

Figure 2:
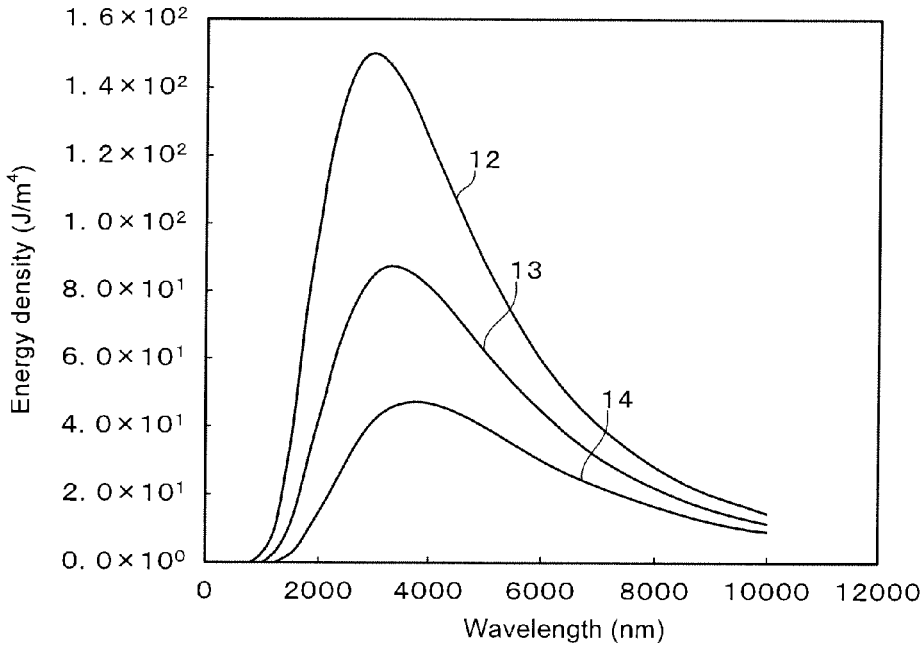
FIG. 2 is a view showing changes in black body radiation energy spectrum with temperature.

FIG. 2 shows changes in radiation spectra with temperatures when it is assumed to perform black body radiation. In FIG. 2, 12 denotes a spectrum at 700° C., 13 denotes a spectrum at 600° C., and 14 denotes a spectrum at 500° C. In the above temperature range of about 500° C. to about 700° C., a peak energy density is at a wavelength of about 2.5 microns to about 4 microns (2500 nm to 4000 nm), and a film having high reflectance with respect to the infrared rays in the above wavelength range is assumed to be particularly excellent in performance as the first high-reflectance film 6 and the second high-reflectance film 10.

Therefore, it is preferable that the first high-reflectance film 6 and the second high-reflectance film 10 have higher reflectance with respect to the electromagnetic wave having a wavelength of 2.5 microns to 4 microns (2500 nm to 4000 nm), but in reality, a sufficient effect can be obtained when the reflectance is 60% or more, in comparison with the case of not forming the film. It is also preferable that the emissivity of the low-emissivity film 9 which is formed on the heat radiation surface of the high-temperature member 1 is as low as possible, but when it is 40% or less in practical use, a sufficient effect can be obtained in comparison with the case that the low-emissivity film 9 is not formed.

Figure 3:
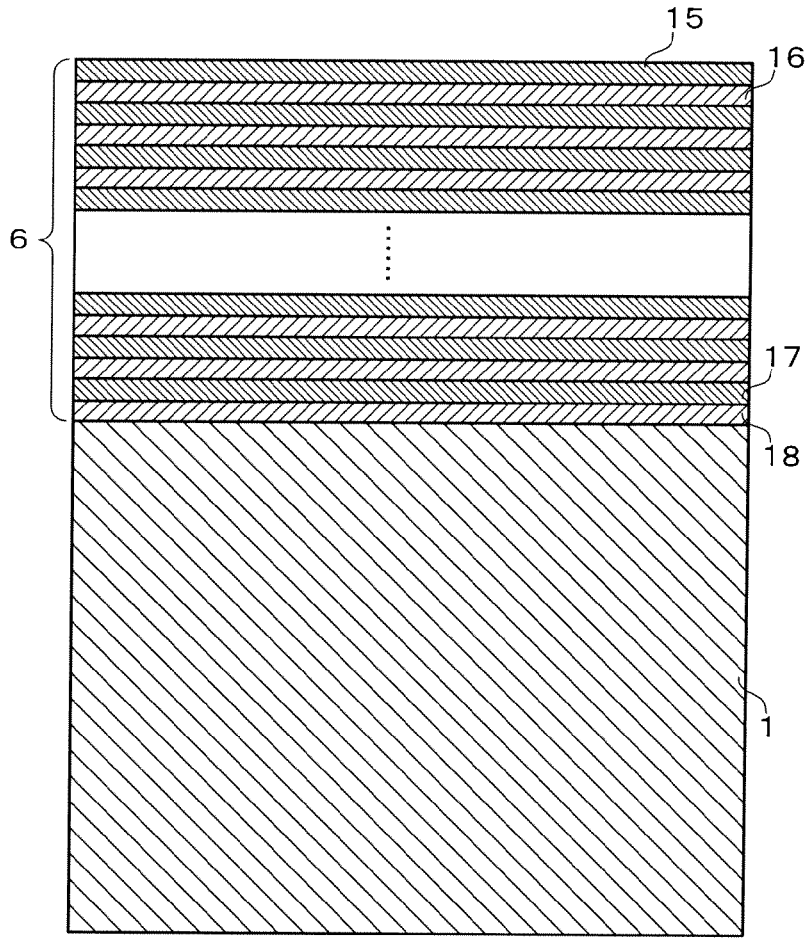
FIG. 3 is a view showing a structure example of a film formed by laminating dielectric thin films having a different refractive index.

To improve the infrared ray reflectance of the film or to decrease the emissivity, there can be used a method of enhancing the reflectance by laminating dielectric substances having a different refractive index and using the interference of reflected lights at the interface. An example of the embodiment using a film having a multilayered structure is shown in FIG. 3. The structure example of the film having the multilayered structure shown in FIG. 3 is of the first high-reflectance film 6 that n layers of a high refractive index layer (1) 15 to a high refractive index layer (n) 17 and n layers of a low refractive index layer (1) 16 to a low refractive index layer (n) 18 are alternately laminated on the surface of the high-temperature member 1.

As the materials for the high refractive index layers (1) 15 to the high refractive index layers (n) 17 and the low refractive index layers (1) 16 to the low refractive index layers (n) 18 described above, oxide based dielectric materials are preferable in view of excellent stability at a high temperature. Candidate materials arranged in order of refractive index are shown in FIG. 4. It is practical to select the materials with a refractive index of around 2 determined as a boundary, and $HfO_2$, NiO and $ZrO_2$ close to the boundary can be selected as materials for the high refractive index layer and the low refractive index layer depending on the other materials.

Considering a long-term stability under the high-temperature steam environment, it is preferable to select from $Al_2O_3$, $Y_2O_3$, $HfO_2$, $ZrO_2$, $ZrO_2$+$TiO_2$, $Ta_2O_5$, $Ce_2O_3$, $Cr_2O_3$, $Nb_2O_5$, $TiO_2$ and the like which are proven as protective films excelling in environment resistance. As a reflection film forming method, a sputtering method, that is one of physical vapor deposition methods, or a physical vapor deposition method using electron beams is preferable because it is necessary to control the film thickness in the micron order. It is preferable that each layer has a thickness of about 0.01 to 10 microns because reflection is enhanced when light path length becomes ¼ of the design wavelength.

Figure 5:
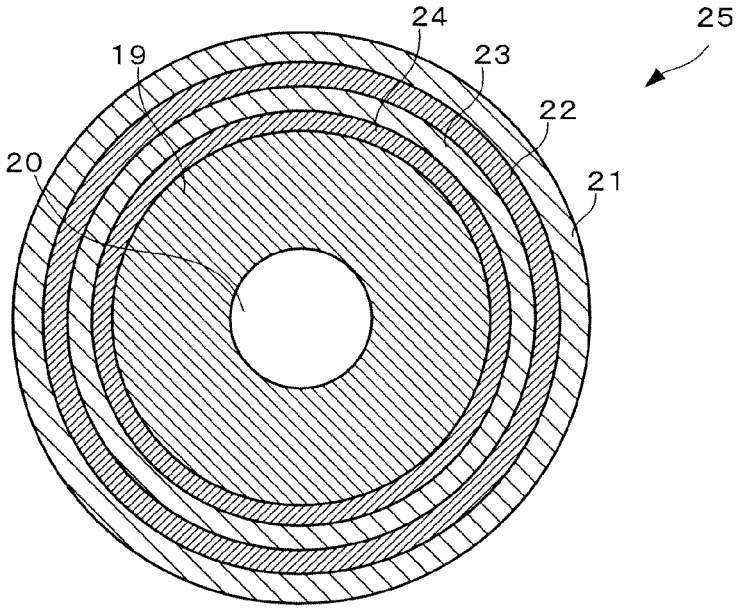
FIG. 5 is a view showing a cross sectional structure of an infrared-ray reflection particle for forming the film.

FIG. 5 is a view illustrating, for example, a spherical infrared-ray reflection particle 25, which configures a high-reflectance film having another structure. In FIG. 5, 19 indicates an oxide particle, and a high refractive index layer (1) 21, a high refractive index layer (2) 23, a low refractive index layer (1) 22 and a low refractive index layer (2) 24, which are formed of dielectric oxides having a different refractive index as described above, are formed on the surface of the oxide particle 19. And, a vacuum region 20 is formed within the oxide particle 19. The infrared ray particle 25 is not limited to a spherical shape. Thus, it is more preferable when the hollow particle having the vacuum region 20 formed within the oxide particle 19 is used, because a thermal conductivity can also be decreased. As the material for the oxide particle 19, a low heat conductive material such as $ZrO_2$, $HfO_2$ or $CeO_2$ is excellent, but it is also possible to use $SiO_2$ or $Al_2O_3$.

Figure 6:
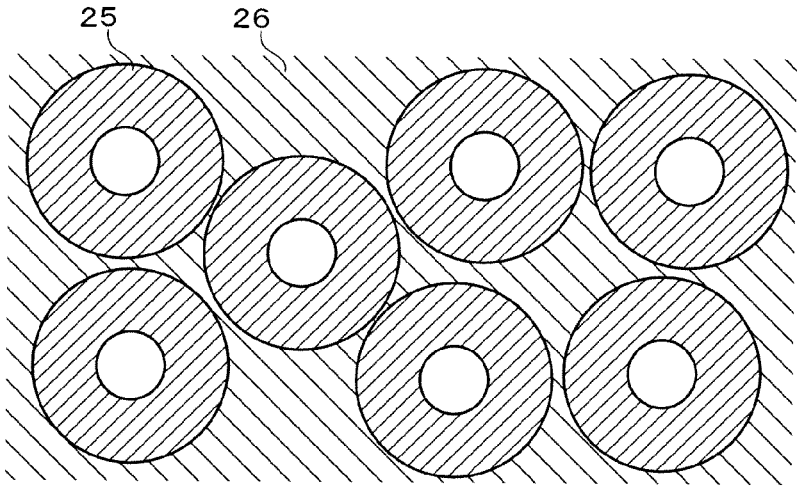
FIG. 6 is a view showing a cross sectional structure of a film using the infrared-ray reflection particle shown in FIG. 5.

An example of a high-reflectance film having another structure using the infrared-ray reflection particle 25 shown in FIG. 5 is shown in FIG. 6. This film has a structure that gaps among the infrared-ray reflection particles 25 are filled with a bonding material 26. As the bonding material 26, either organic or inorganic material may be used, but an inorganic binder such as colloidal silica, lithium silicate, sodium silicate, aluminum phosphate or cement is preferably used in view of heat resistance and environment resistance.

Figure 7:
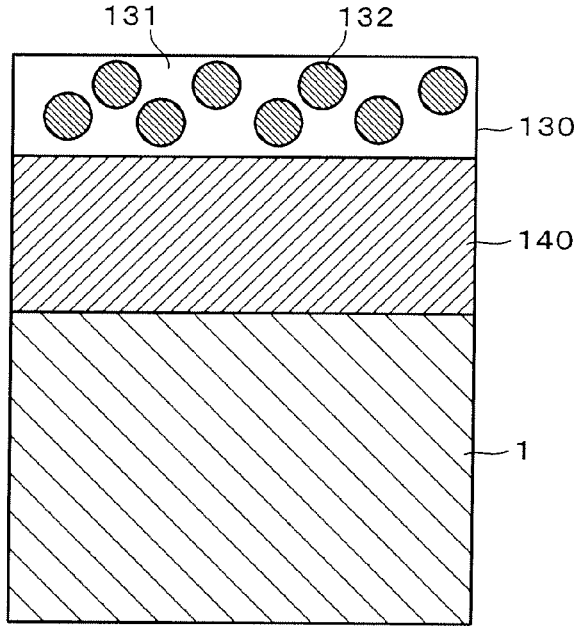
FIG. 7 is a view schematically showing a cross-sectional structure of a main portion of another embodiment.

FIG. 7 is a view schematically showing a structure of an embodiment using a high-reflectance film having a different structure. In this embodiment, an oxide containing silicon oxide is determined to be matrix 131, and the high-reflectance film is formed of a dense layer 130 having a porosity of 3% or less and containing a filler 132 formed of oxide particles or metal particles different from the matrix 131. When the filler 132 is formed of oxide particles, the content of the filler 132 is determined to be 20 to 80 vol %. And, when the filler 132 is formed of metal particles, the content of the filler 132 is determined to be 10 to 80 vol %. The reason is described later.

As the matrix 131, there is used ceramics mainly containing $SiO_2$ (silica) which forms a glassy phase. The reason of using ceramics which forms the glassy phase is because the dense layer 130 having less defects can be formed. As the matrix 131, it is also possible to use an aluminosilicate compound, such as mullite which is formed from alumina and silica, other than pure silica.

As the filler 132, metals or various types of materials of oxides (ceramics) different form the matrix 131 can be used if they are materials that reflect infrared rays of a wavelength that steam emits, but to select them, it is important to consider the temperature to which the dense layer 130 is exposed. That is, when it is used for a portion having a relatively low temperature of less than 600° C., it is preferable to use a metal filler of aluminum, silver, platinum or gold which has metallic luster and high reflectance, but there is a possibility that the reflectance is lowered considerably because oxidization occurs when the temperature becomes high. Therefore, when it is used for any portion which has a high temperature exceeding 600° C., a heat shielding effect can be kept for a long period by using a filler mainly containing titanium dioxide, aluminum oxide, zirconium oxide or the like which is extensively used as a white pigment. A filler mainly containing a silicate compound can also be used.

As a method of forming the dense layer 130, it is preferable to use a method using slurry/gel. That is, a slurry/gel-like gel-like material which is a mixture of an oxide precursor for forming a silica matrix and a material for the filler is coated on a base material by thermal spraying, or the base material is immersed to form a film containing water and an organic compound. Then, the water and the organic compound are volatilized by drying and sintering processes to form a matrix, which mainly contains silica, from the ceramics precursor. Even on the parts which have a complex shape, such as the high temperature parts of the steam turbine, the dense layer 130 can be formed relatively easily by the above method. As a material which has a slurry/gel-like form at room temperature and forms a compound containing silicon such as $SiO_2$ by calcining at a high temperature, a compound containing siloxane bond having various end stopping functional groups, various silicon emulsion materials and the like can be used.

Figure 8:
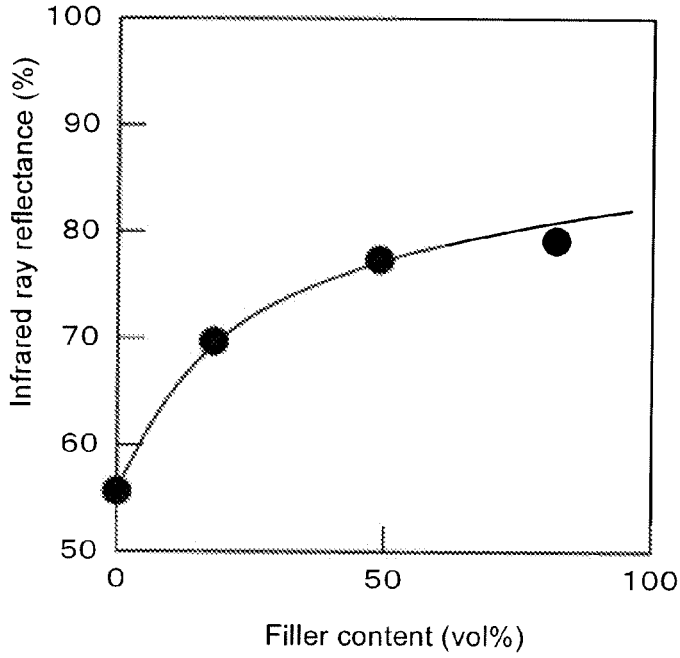
FIG. 8 is a graph showing a relationship between a filler content and reflectance when an oxide filler is used.

When $TiO_2$ is used as the filler 132, and its content is changed from 0 volt to 90 vol %, changes in infrared ray reflectance (wavelength of 2.7 microns) are shown in the graph of FIG. 8 that the longitudinal axis represents infrared ray reflectance, and the horizontal axis represents a filler content (vol %). Infrared ray reflectance increases abruptly when the content of the filler 132 becomes about 20 vol % and tends to increase slightly with a further increase of the filler 132. Therefore, when the oxide (ceramics) such as $TiO_2$ is used as the filler 132, it is necessary to increase its content to 20 vol % or more.

Figure 9:
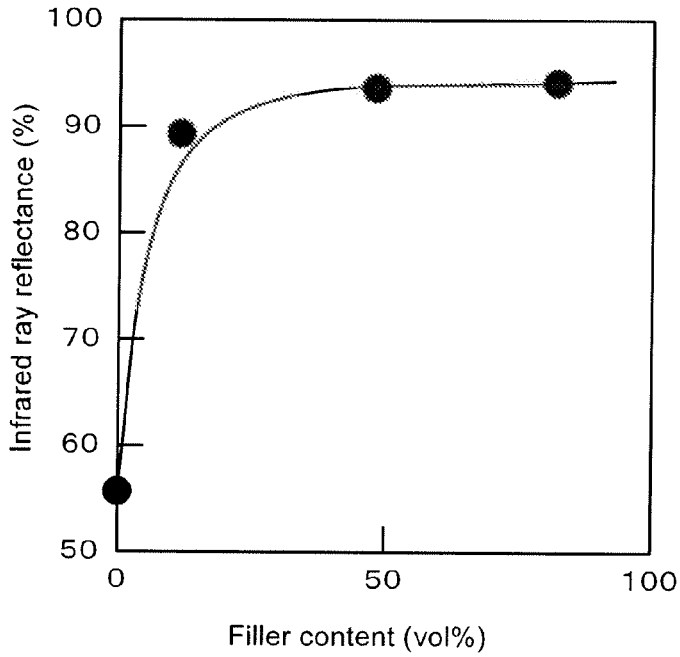
FIG. 9 is a graph showing a relationship between a filler content and reflectance when a metal filler is used.

Meanwhile, when metal is used as the filler 132 and its content is changed from 0 vol % to 90 vol %, changes in infrared ray reflectance (wavelength of 2.7 microns) are shown in the graph of FIG. 9 that the longitudinal axis represents infrared ray reflectance, and the horizontal axis represents a filler content (vol %). Infrared ray reflectance exceeds 70% when the content of the filler 132 becomes 10 vol % or more. Therefore, when metal is used as the filler 132, the content of the filler 132 may be determined to be 10 volt or more. Generally, when the transmission rate is 0, a relationship between the reflectance and the emissivity is expressed by the following equation.

$$\text{Reflectance}=1-\text{emissivity}$$

A metal base material the surface of which is not coated has reflectance of about 0.7 when it is not oxidized and emissivity of about 0.3. Therefore, it is preferable that the reflectance of the dense layer 130 is increased to be higher than 0.7. But, since it is general that the reflectance is degraded considerably when the metal base material is oxidized, a sufficient effect of suppressing the radiation heat transmission can be expected when oxidization in the high-temperature steam is suppressed even if the initial reflectance and emissivity are at the same level as those of the metal base material.

To evaluate the adhesiveness of the dense layer 130, tests of applying and peeling adhesive tapes were performed according to JIS K5600. It was found as the results that if the content of the metal filler or the oxide filler exceeds 80 vol %, the dense layer 130 remains on the tape side after the adhesive tape is peeled, and adhesiveness is low. It is considered from the results that the strength of the dense layer 130 lowers when the amount of the oxide having silica as the main component which becomes the matrix decreases considerably. Therefore, it is necessary to determine that the filler content is 80 vol % or less.

From the above, when the oxide (ceramics) is used as the filler 132, the filler content is determined to be 20 to 80 vol % and when metal is used as the filler 132, the filler content is determined to be 10 to 80 vol %. Thus, the necessary reflectance can be secured, and the film's necessary adhesiveness and strength can be secured. As shown in FIG. 2, the steam absorption spectrum to be reflected on the dense layer 130 has a broad wavelength range, but since a high absorption peak is when the wavelength is about 2.7 microns (2700 nm), a film having high reflectance against the steam can be obtained by using the dense layer 130 having a high reflectance with the above wavelength at the center. The above configured dense layer 130 serves to suppress the heat transmission due to radiation from the steam or to suppress radiation from the member to the cooling steam, and to prevent the steam from entering into a lower porous ceramics layer 140 described later.

As first to third low heat conductive films formed as layers below the above-described dense layer 130, the porous ceramics layer 140 having a porosity of 5 to 50% is used in this embodiment. It is preferable that the porous ceramics layer 140 has a thickness of 100 microns or more because thermal resistance increases as the thickness of the porous ceramics layer 140 increases, and an effect to relieve a thermal stress generated due to a difference in thermal expansion coefficient between the base material (high-temperature member 1) and the dense layer 130 also becomes high.

When the porosity of the porous ceramics layer 140 is increased, it is effective to lower the thermal conductivity and to relieve a thermal stress due to a difference in thermal expansion coefficient with respect to the base material (high-temperature member 1). And, it is preferable to increase to 5% or more, and more preferable to increase to 10% or more. But, when the porosity is excessively high, cracks spread to join the pores, and the strength is decreased. Therefore, the porosity is preferably suppressed to 50% or less, and more preferably to 25% or less. This porous ceramics layer 140 can be formed by, for example, an atmospheric plasma spraying method. This method forms a film by using a thermal spraying gun, charging and melting ceramics powder in a high-speed arc plasma flow in the atmosphere, colliding its droplets against the base material surface at a high speed, and solidifying on the base material. Normally, layers are laminated by scanning by the thermal spraying gun to form a thick ceramics film of several hundred microns to several millimeters on the base material having a large area. It is possible to control the porosity in the film by using hollow powder as the powder to be charged and controlling plasma output and a distance between the thermal spraying gun and the base material.

The material for the porous ceramics layer 140 is not particularly limited if the material has a low thermal conductivity and a high temperature stability, but it is desirable to use zirconia which is phase-stabilized by yttria from viewpoints of the past results, a large thermal expansion coefficient in the ceramics and the like. But, since it is known that corrosion is caused by steam when a yttria amount is small as a stabilizing agent or a material with yttria segregation is used, it is desirable to use at least 5 mass % or more, and preferably 8 mass % of more of zirconia as a content of yttria. An oxide which has the same fluorite type crystal structure as that of zirconia such as hafnia or ceria can also be used, but it is necessary to control the added amount of a stabilizing agent such as yttria or rare earth oxide so that an unstable phase is not formed even in steam. A rare earth oxide such as yttrium or lanthanum can also be used.

Figure 10:
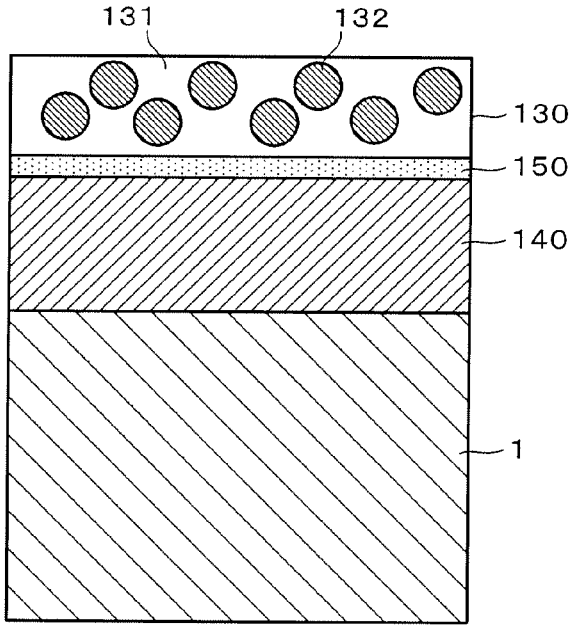
FIG. 10 is a view schematically showing a cross-sectional structure of a main portion of a modified example.

FIG. 10 shows a structure of a modified example of the above embodiment, and a ceramics bonding layer 150 is formed between the dense layer 130 and the porous ceramics layer 140 in this modified example. As the ceramics bonding layer 150, it is preferable to use a material which has a high bonding strength and a thermal expansion coefficient falling in an intermediate level of those of the porous ceramics layer 140 and the dense layer 130. And, a layer formed of the matrix 131 not containing the filler 132 may be used. By configuring as described above, adhesiveness of the individual layers can be improved.

Figure 11:
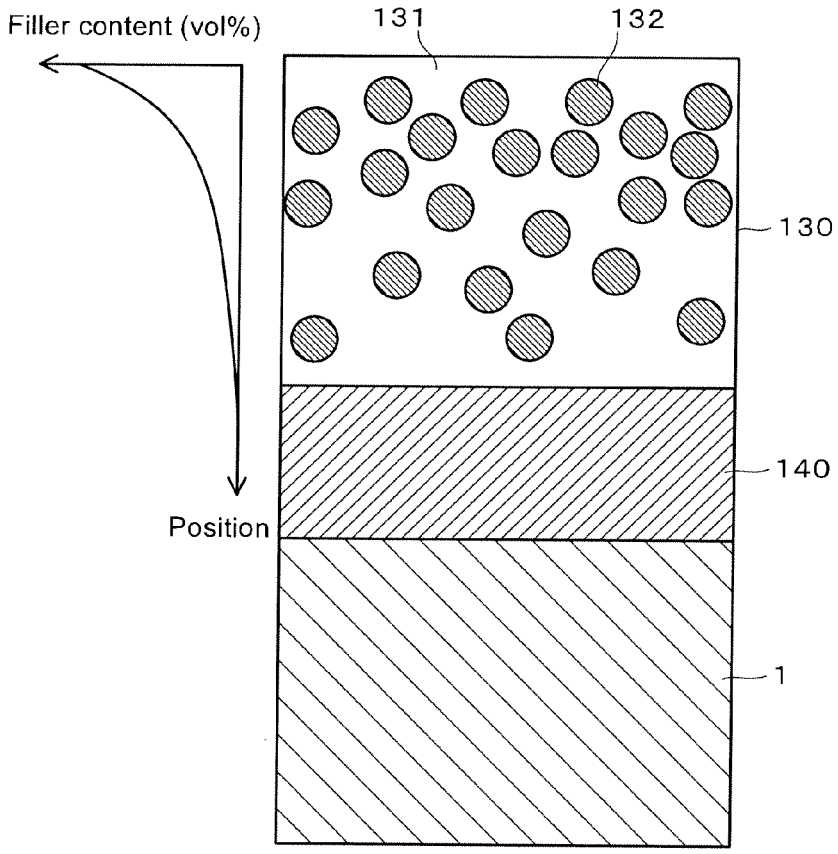
FIG. 11 is a view schematically showing a cross-sectional structure of a main portion of another modified example.

FIG. 11 shows a structure of another modified example, and as shown on the left side in FIG. 11, the content (vol %) of the filler 132 is indicated to slant toward the thickness direction of the dense layer 130, and the content of the filler 132 is large on the surface side but small on the porous ceramics layer 140 side in this modified example. When the dense layer 130 is determined to have the above structure, its adhesiveness to the porous ceramics layer 140 is high, and a film also excelling in reflection of infrared rays can be provided.

Figure 12:
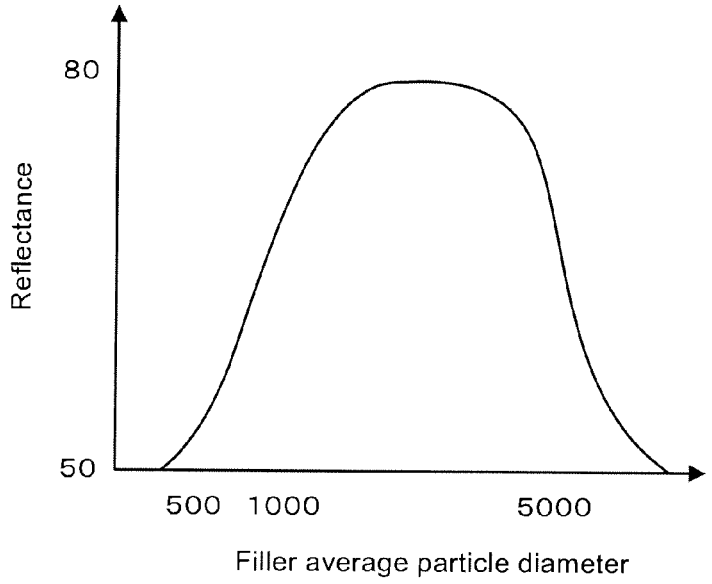
FIG. 12 is a graph showing a relationship between a filler's average particle diameter and reflectance.

FIG. 12 is a graph showing a relationship between an average particle diameter and the reflectance of a 10-micron thick film which has the $TiO_2$ filler 132 dispersed in volume fraction of 50% within an Si base matrix, with the reflectance represented on the vertical axis and the average particle diameter of filler represented on the horizontal axis. When the average particle diameter of the filler 132 is smaller than ¼ of the wavelength of the infrared rays, the transmittance of the infrared rays is large, and the reflectance of the film decreases. Therefore, it is preferable that the average particle diameter of the filler 132 is ¼ or more of the wavelength of the infrared rays. And, when the average particle diameter of the filler 132 is larger than ½ of the film thickness, it is probable that the infrared rays does not hit the filler 132 but its dose passing through the film increases, so that it is preferable that the average particle diameter of the filler 132 is ½ or less of the film thickness.

The dense layer 130 configured as described above can also be used as a high reflectance film or a low-emissivity film for steam devices configured to have any structure other than the steam device configured as shown in FIG. 1. In such a case, as the base material forming the dense layer 130, for example, a ferrite-based steel material, an austenite-based steel material, or an alloy mainly containing nickel can be used for all types of base materials. And, it is preferable to dispose the porous ceramics layer 140 having a low thermal conductivity between the dense layer 130 and the base material to improve heat insulating properties.

Figure 13:
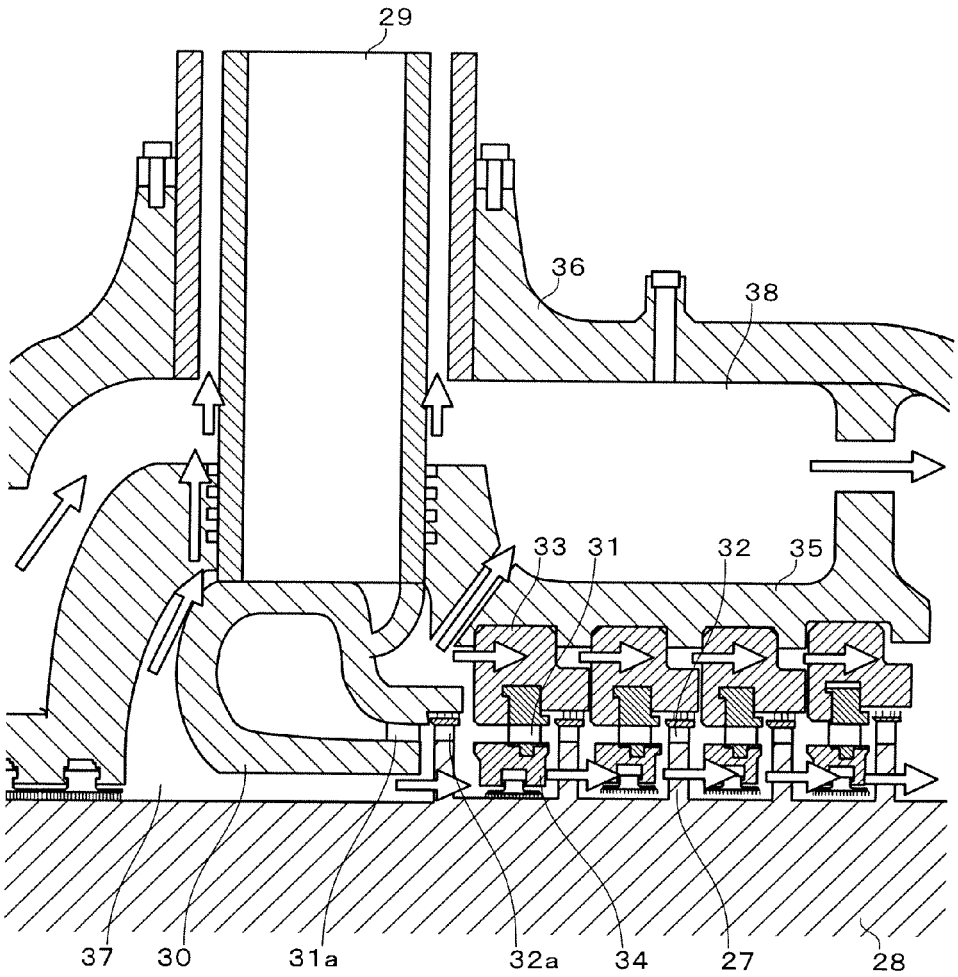
FIG. 13 is a view showing a cross sectional structure of an upper half casing portion of a high-temperature steam turbine.

FIG. 13 shows an example of a cross sectional structure of an upper half casing portion of a high-temperature steam turbine to which the invention is applied. As shown in FIG. 13, the steam turbine is provided with a double casing structure consisting of an inner casing 35 and an outer casing 36 on its outside, a heat chamber 38 is formed between the casings, and cooling steam flows within it. A turbine rotor 28 is formed through the center part of the inner casing 35. And, a nozzle diaphragm outer wheel 33 is fixed to the inner surface of the inner casing 35, and nozzles 31 comprising plural stages are disposed. And, moving blades 32 are implanted on the turbine rotor 28 side via wheel portions 27 in correspondence with the nozzles. A first-stage nozzle 31*a* has a structure fixed to a nozzle box 30 which becomes an inlet passage for high-temperature steam from a steam inlet pipe 29 to the turbine portion.

The steam inlet pipe 29, the nozzle box 30, the nozzles 31*a* and 31, the moving blades 32*a* and 32, the nozzle diaphragm outer wheel 33 and a nozzle diaphragm inner wheel 34, which are exposed to high-temperature steam having a temperature of about 700° C. to about 550° C., have a high high-temperature strength property (e.g., 100,000-hour creep rupture strength), and a corrosion-resistant and heat-resistant alloy excelling in steam corrosion resistance is applied. For such an alloy, it is considered to apply a Ni-base alloy, for example, Inco625, Inco617 or Inco713 (trade names) manufactured by Inconel. In FIG. 13, 37 is a cooling steam passage.

Figure 14:
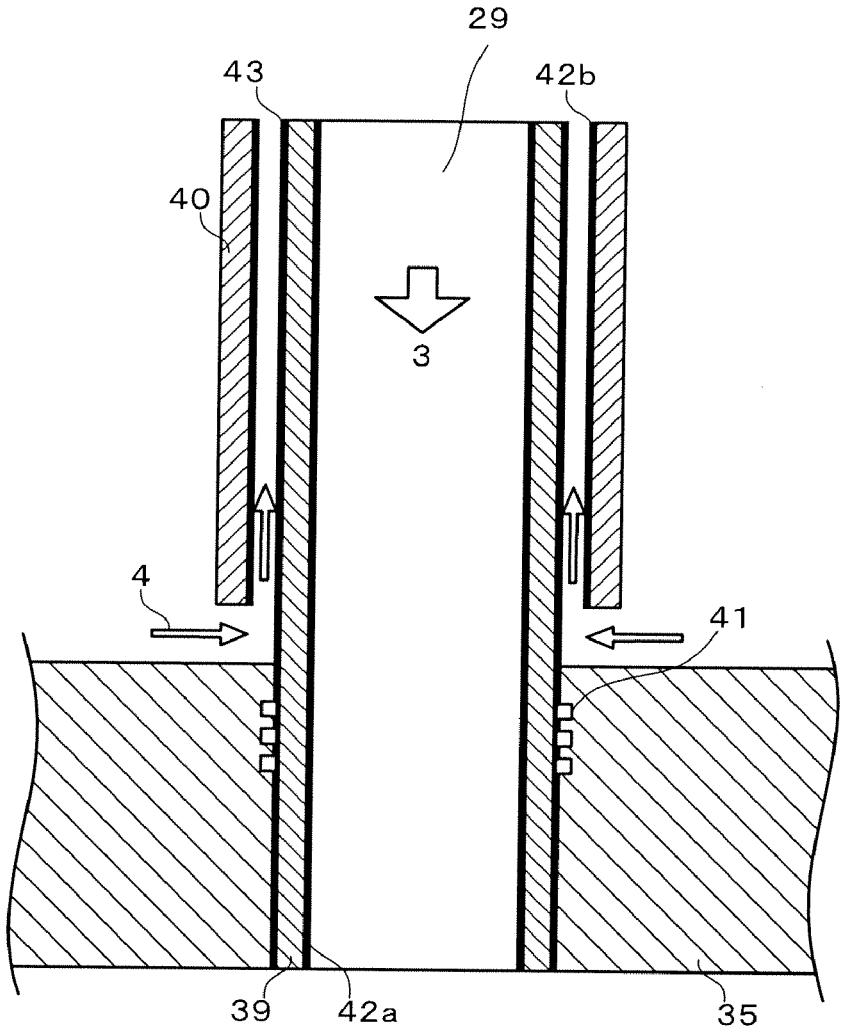
FIG. 14 is a view showing an embodiment that the present invention is applied to a steam inlet pipe portion of the steam turbine.

FIG. 14 shows a magnified part of the steam inlet pipe 29 of the upper half casing portion of the high-temperature steam turbine. The steam inlet pipe 29 is determined to have a double structure of an inside high temperature sleeve 39 and an outside inlet pipe casing 40 or the inner casing 35, and the cooling steam 4 flows through the space between them. By configuring as described above, it becomes possible to suppress effectively the heat conductance by radiation or heat transfer from the steam inlet pipe 29 to the member using a material having a low heat-resistant temperature such as the outside casing or to suppress the penetration of heat from the high-temperature steam 3 to the steam inlet pipe 29, and the reliability of the steam inlet pipe 29 is improved and its service life is elongated.

A heat receiving surface side film 42*a* corresponding to the first high-reflectance film 6 shown in FIG. 1 is formed on the inner surface of the high temperature sleeve 39. As described above, this heat receiving surface side film 42*a* is a film having at least an infrared ray reflection function and may be a film having both the infrared ray reflection function and a thermal barrier function. As the heat receiving surface side film 42*a*, a film having a structure that the first high-reflectance film 6 and the first low heat conductive film 7 shown in FIG. 1 are laminated may be used. When the heat receiving surface side film 42*a* is formed as described above, the temperature of the high temperature sleeve 39 can be decreased, and damage or degradation can be eased.

A heat radiation surface side film 43 corresponding to the low-emissivity film 9 shown in FIG. 1 is formed on the outside surface of the high temperature sleeve 39. The heat radiation surface side film 43 is appropriate when it is at least a low-emissivity film and may be a film having a low emissivity and a thermal barrier function. As the heat radiation surface side film 43, a film having a structure that the low-emissivity film 9 and the second low heat conductive film 8 shown in FIG. 1 are laminated may be used. In addition, a heat receiving surface side film 42*b* corresponding to the second high-reflectance film 10 shown in FIG. 1 is formed on the inner surface of the inlet pipe casing 40. The heat receiving surface side film 42*b* is a film having at least an infrared ray reflection function and may be a film having both the infrared ray reflection function and the thermal barrier function. As the heat receiving surface side film 42*b*, a film having a structure that the second high-reflectance film 10 and the third low heat conductive film 11 shown in FIG. 1 are laminated may be used.

As described above, when the heat radiation surface side film 43 and the heat receiving surface side film 42*b* are formed, the inlet pipe casing 40 having a low heat resistance is prevented from a temperature increase, and deterioration and damage can be eased. But, for the heat radiation surface side film 43, a film having quite different properties may be demanded depending on a use environment. That is, when a flow rate of the cooling steam 4 is appropriately large, it is also considered that the heat radiation surface side film 43 is not formed, or a film having high thermal conductivity and emissivity is formed to decrease the temperature of the high temperature sleeve 39. Positions where the above films are formed can be determined according to the specifications of the device.

When it is hard to form the above-described films directly on the member surface or when peeling occurs if the films are directly formed on the member, it is also possible to have a structure by forming a plate-like block made of a heat resistant material, for example, a heat resistant tile, forming the film on its surface, and fixing the obtained heat resistant tile to the surface of the member. The same manner can also be applied to the individual embodiments described below.

Figure 15:
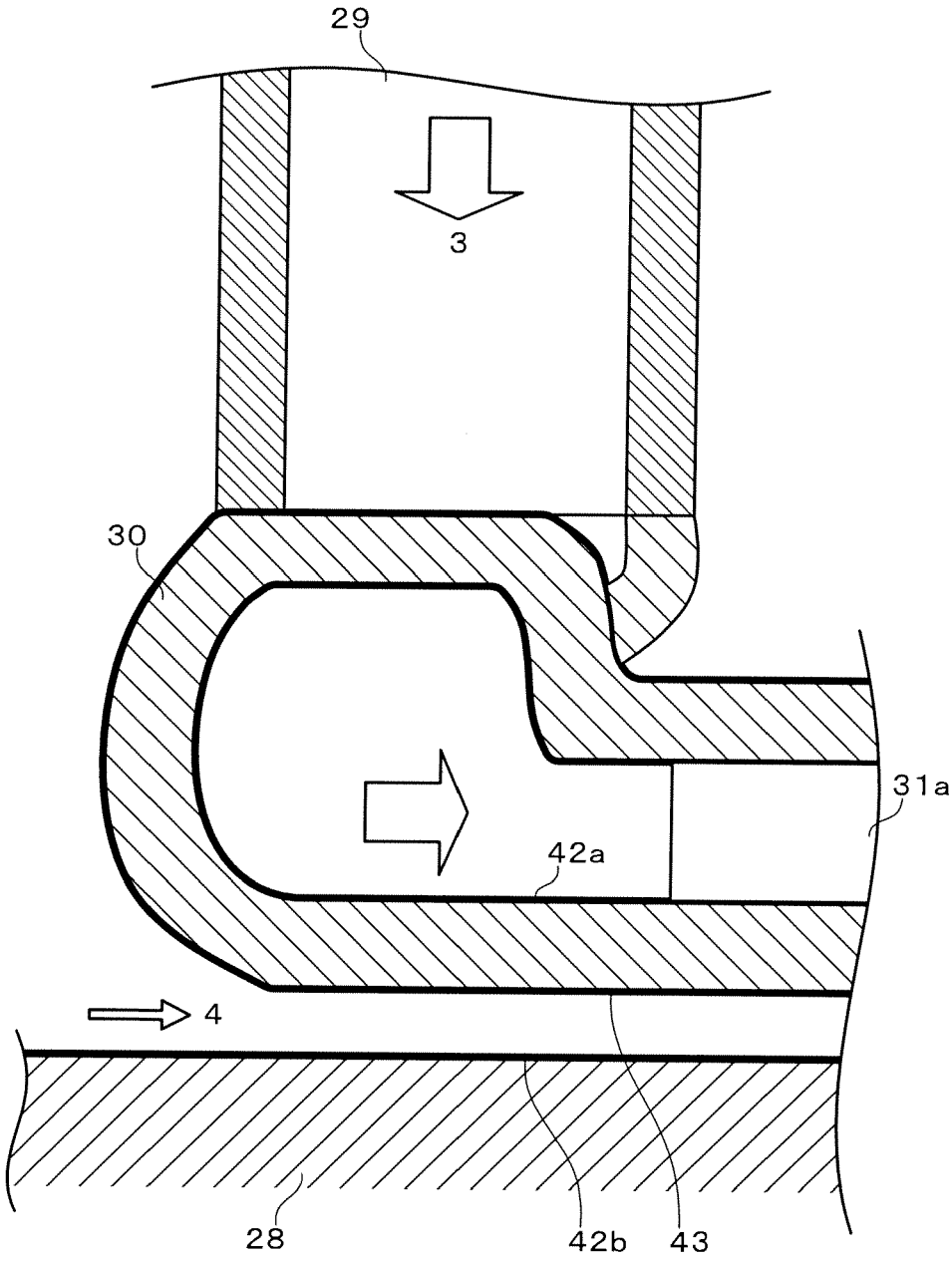
FIG. 15 is a view showing an embodiment that the present invention is applied to a nozzle box portion of the steam turbine.

FIG. 15 shows a magnified part of the nozzle box 30 which is disposed in the upper half casing portion of the high-temperature steam turbine shown in FIG. 13 and guides the high-temperature steam 3 to the turbine portion. As shown in FIG. 15, the nozzle box 30 has a structure that its outer periphery surface is cooled by the cooling steam 4, the heat receiving surface side film 42*a* is formed on the inner surface of the nozzle box 30, and the heat radiation surface side film 43 is formed on the outside surface of the nozzle box 30, and particularly on the surface opposed to the rotor. In addition, the heat receiving surface side film 42*b* is formed on the surface of the turbine rotor 28 opposed to the nozzle box. The heat receiving surface side film 42*a*, the heat receiving surface side film 42*b* and the heat radiation surface side film 43 described above are configured in the same manner as in the embodiment shown in FIG. 14 described above. By configuring as described above, it becomes possible to improve the reliability and service life of the nozzle box 30 by effectively suppressing the heat conductance from the high temperature nozzle box 30 to the outside casing portion or the like, effectively suppressing the penetration of heat from the high-temperature steam 3 to the nozzle box 30, and reducing a thermal stress. A change of the demanded properties of the heat radiation surface side film 43 depending on a flow rate of the cooling steam or the like is the same as that in the case of the above-described steam inlet pipe 29. And, the inner casing is determined as an inlet route for the high-temperature steam without using the nozzle box depending on the specifications of the steam turbine, but in the above case, the same effect as that when the nozzle box is provided can be obtained even when the film is formed on the inner casing.

Figure 16:
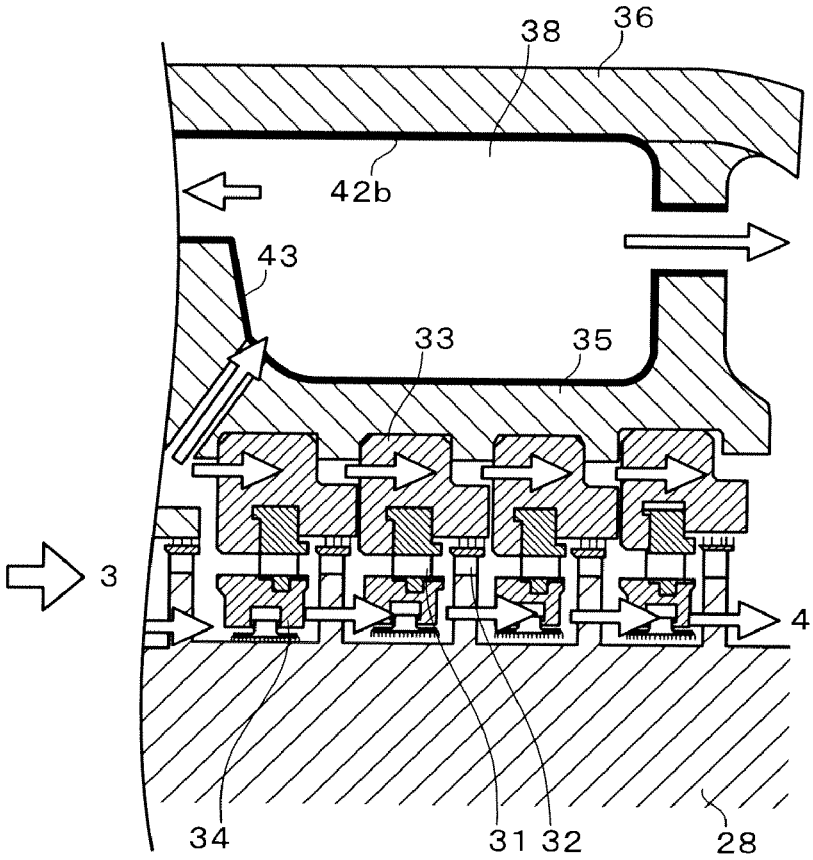
FIG. 16 is a view showing an embodiment that the present invention is applied to a heat chamber portion of the steam turbine.

FIG. 16 shows a magnified part of the heat chamber 38 of the upper half casing portion of the high-temperature steam turbine shown in FIG. 13. As shown in FIG. 16, the steam turbine having the double casing structure has the heat chamber 38 between the inner casing 35 and the outer casing 36. The heat radiation surface side film 43 is formed on the outer surface of the inner casing 35, and the heat receiving surface side film 42*b* is formed on the inner surface of the outer casing 36 which is disposed outside of the inner casing 35 and opposed to the inner casing 35. The above-described heat receiving surface side film 42*b* and heat radiation surface side film 43 are configured in the same manner as in the embodiment shown in FIG. 14 described above. The above-described configuration provides effects that the penetration of heat from the inner casing 35 to the outer casing 36 can be suppressed, a temperature increase in the heat chamber 38 is suppressed, damage or degradation of the outer casing 36 is suppressed, and reliability of the steam turbine is improved. The demanded properties of the heat radiation surface side film 43 are variable depending on the flow rate of the cooling steam or the like in the same manner as in the case of the above-described steam inlet pipe 29.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A steam device, comprising:

a first member one side of which is exposed to high-temperature steam and the other side of which is cooled by low-temperature steam having a temperature lower than that of the high-temperature steam; and a second member which is disposed to face the first member with a passage for the low temperature steam between them and is formed of a material having a heat resistance lower than that of the first member;

at least one of:

a first high-reflectance film which is formed on the surface of the first member exposed to the high-temperature steam and which has a reflectance with respect to infrared rays higher than the first member, and a second high-reflectance film which is formed on the surface of the second member facing the first member and which has a reflectance with respect to infrared rays higher than the second member.

2. A steam device according to claim 1, further comprising:

a low-emissivity film which is formed on the surface of the first member cooled by the low-temperature steam and which has emissivity lower than the first member.

3. The steam device according to claim 1, wherein the first and second high-reflectance films have a structure that a low refractive index material layer and a high refractive index material layer, which has a refractive index higher than that of the low refractive index material layer, are laminated.

4. The steam device according to claim 3, wherein the low refractive index material layer and the high refractive index material layer are formed of a dielectric oxide containing at least one selected from aluminum oxide ($Al_2O_3$), silicon oxide ($SiO_2$), gallium oxide ($Ga_2O_3$), magnesium oxide (MgO), samarium oxide ($Sm_2O_3$) yttrium oxide ($Y_2O_3$), zirconium oxide ($ZrO_2$), nickel oxide (NiO), hafnium oxide ($HfO_2$), cerium oxide ($Ce_2O_3$), chromium oxide ($Cr_2O_3$), niobium oxide ($Nb_2O_5$), tantalum oxide ($Ta_2O_5$), tungsten oxide ($WO_3$), titanium dioxide ($TiO_2$) and zinc oxide (ZnO), and the low refractive index material layer has a refractive index lower than that of the high refractive index material layer.

5. The steam device according to claim 1, wherein the first and second high-reflectance films have a structure that a plurality of particles, which have at least two types of dielectric oxide layers having a different refractive index laminated on the surfaces of oxide particles, are bonded by a substance formed of an inorganic or organic material.

6. The steam device according to claim 1, wherein a film having a thermal conductivity of 5 W/mK or less is laminated on at least one of the first high-reflectance film and the second high-reflectance film.

7. The steam device according to claim 1, wherein the first and second high-reflectance films are formed of a dense layer having a porosity of 30 or less which has an oxide containing silicon oxide as matrix and contains 20 to 80 vol % of a filler formed of particles of an oxide different from the matrix.

8. The steam device according to claim 7, wherein a heat-insulating ceramics layer which has a thermal conductivity lower than that of the dense layer is formed as a lower layer of the dense layer.

9. The steam device according to claim 8, wherein the heat-insulating ceramics layer has a porosity of 5% to 50%.

10. The steam device according to claim 8, wherein the heat-insulating ceramics layer is formed of any of zirconium oxide, cerium oxide, hafnium oxide, yttrium oxide, and boride.

11. The steam device according to claim 7, wherein the dense layer has emissivity of 0.3 or less or reflectance of 0.7 or more with respect to infrared rays having a wavelength of 2.7 microns.

12. The steam device according to claim 7, wherein the filler has as a main component at least one oxide selected from aluminum oxide ($Al_2O_3$), zirconium oxide ($ZrO_2$) and titanium oxide ($TiO_2$).

13. The steam device according to claim 1, wherein the first and second high-reflectance films are formed of a dense layer having a porosity of 3% or less which has an oxide containing silicon oxide as matrix and contains 10 to 80 vol % of a filler formed of metal particles.

14. The steam device according to claim 13, wherein the filler has as a main component at least one selected from aluminum, silver, platinum and gold.

15. The steam device according to claim 1, wherein the first member is a high temperature sleeve of a steam inlet pipe of a steam turbine, and the second member is an inlet pipe casing which surrounds the periphery of the high temperature sleeve.

16. The steam device according to according to claim 1, wherein the first member is a component member of a nozzle box portion which guides inlet steam of the steam turbine to the turbine portion, and the second member is a turbine rotor which is opposed to a component member of the nozzle box portion.

17. The steam device according to claim 1, wherein the first member is an inner casing which fixes a nozzle diaphragm of the steam turbine, and the second member is an outer casing which is on the outside of the inner casing.

18. The steam device according to claim 1, wherein the first or second high-reflectance film is formed on the surface of a heat resistant tile, and the heat resistant tile is fixed to the first or second member.

19. A steam device, comprising:

a first member one side of which is exposed to high-temperature steam and the other side of which is cooled by low-temperature steam having a temperature lower than that of the high-temperature steam;

a second member which is disposed to face the first member with a passage for the low temperature steam between them and is formed of a material having a heat resistance lower than that of the first member; and a low-emissivity film which is formed on the surface of the first member cooled by the low-temperature steam and which has emissivity lower than the first member.

20. The steam device according to claim 19, wherein the low-emissivity film has a structure that a low refractive index material layer and a high refractive index material layer, which has a refractive index higher than that of the low refractive index material layer, are laminated.

21. The steam device according to claim 19, wherein the low-emissivity film has a structure that a plurality of particles, which have at least two types of dielectric oxide layers having a different refractive index laminated on the surfaces of oxide particles, are bonded by a substance formed of an inorganic or organic material.

22. The steam device according to claim 19, wherein a film having a thermal conductivity of 5 W/mK or less is laminated on the low-emissivity film.

23. The steam device according to claim 19, wherein the low-emissivity film is formed of a dense layer having a porosity of 3% or less which has an oxide containing silicon oxide as matrix and contains 20 to 80 vol % of a filler formed of particles of an oxide different from the matrix.

24. The steam device according to claim 23, wherein the filler has as a main component at least one oxide selected from aluminum oxide ($Al_2O_3$), zirconium dioxide ($ZrO_2$), and titanium dioxide ($TiO_2$).

25. The steam device according to claim 23, wherein the dense layer has emissivity of 0.3 or less or reflectance of 0.7 or more with respect to infrared rays having a wavelength of 2.7 microns.

26. The steam device according to claim 23, wherein a heat-insulating ceramics layer having a thermal conductivity lower than that of the dense layer is formed as a lower layer of the dense layer.

27. The steam device according to claim 26, wherein the heat-insulating ceramics layer has a porosity of 5% to 50%.

28. The steam device according to claim 19, wherein the low-emissivity film is formed of a dense layer having a porosity of 3% or less which has an oxide containing silicon oxide as matrix and contains 10 to 80 vol % of a filler formed of metal particles.

29. The steam device according to claim 28, wherein the filler has as a main component at least one selected from aluminum, silver, platinum and gold.

30. The steam device according to claim 19, wherein the low-emissivity film is formed on the surface of the heat resistant tile, and the heat resistant tile is fixed to the first member.

* * * * *